US006494186B1

(12) United States Patent
Wakeman

(10) Patent No.: US 6,494,186 B1
(45) Date of Patent: Dec. 17, 2002

(54) INTEGRAL ENGINE CONTROL SENSOR

(75) Inventor: Russell J. Wakeman, Canton, MI (US)

(73) Assignee: Siemens VDO Automotive Corporation, Auburn Hills, MI (US)

( * ) Notice: Subject to any disclaimer, the term of this patent is extended or adjusted under 35 U.S.C. 154(b) by 24 days.

(21) Appl. No.: 09/661,983

(22) Filed: Sep. 15, 2000

Related U.S. Application Data

(60) Provisional application No. 60/156,881, filed on Sep. 30, 1999.

(51) Int. Cl.[7] ..... F02D 41/22; F02M 35/104

(52) U.S. Cl. ..... 123/479; 123/456; 123/470; 123/494; 123/184.61; 73/119 A

(58) Field of Search ..... 123/479, 494, 123/184.61, 470, 456, 478; 73/119 A

(56) References Cited

U.S. PATENT DOCUMENTS

| | | | | |
|---|---|---|---|---|
| 4,002,155 A | | 1/1977 | Harned et al. | 123/406.39 |
| 4,523,458 A | * | 6/1985 | Daniel | 73/119 A |
| 4,976,243 A | | 12/1990 | Sano et al. | 123/492 |
| 5,136,998 A | * | 8/1992 | Deutsch | 123/406.4 |
| 5,163,406 A | | 11/1992 | Daly et al. | 123/456 |
| 5,181,496 A | | 1/1993 | Kojima | 123/493 |
| 5,359,975 A | | 11/1994 | Katashiba et al. | 123/435 |
| 5,410,999 A | * | 5/1995 | Gillespie et al. | 123/403 |
| 5,482,019 A | | 1/1996 | Ausiello et al. | 123/361 |
| 5,513,613 A | * | 5/1996 | Taylor et al. | 123/456 |
| 5,605,135 A | | 2/1997 | Netherwood | 123/479 |
| 5,655,500 A | | 8/1997 | Kato | 123/336 |
| 5,657,733 A | | 8/1997 | Dozier et al. | 123/470 |
| 5,682,859 A | | 11/1997 | Wakeman | 123/470 |
| 5,713,322 A | | 2/1998 | Mausner et al. | 123/184.21 |
| 5,718,202 A | | 2/1998 | Bentz et al. | 123/399 |
| 5,771,863 A | | 6/1998 | Daly | 123/456 |
| 5,809,974 A | | 9/1998 | Osakabe | 123/494 |
| 6,167,855 B1 | * | 1/2001 | Mammarella et al. | 123/184.21 |

FOREIGN PATENT DOCUMENTS

| | | |
|---|---|---|
| EP | 0821160 | 1/1998 |
| EP | 0889213 | 1/1999 |
| EP | 0921294 | 6/1999 |
| JP | 57020553 | 5/1982 |

OTHER PUBLICATIONS

International Search Report mailed on Dec. 27,2000 for PCT/US00/25655.

* cited by examiner

*Primary Examiner*—Andrew M. Dolinar

(57) ABSTRACT

A vehicle fluid directing includes an engine control unit (ECU) mounted directly to the intake manifold to provide engine management and diagnostic functions. A case encloses the ECU to hermetically seal and protect the circuit board and attached components. Sensors preferably extend through the case and into the intake manifold to receives a direct input to the medium passing through the intake manifold. In another embodiment, a sensor such as an accelerometer which does not extend from the case receives vibration input. As the entire circuit board is directly mounted to the intake manifold, the vibrations are received as input to the sensor.

11 Claims, 2 Drawing Sheets

INTEGRAL ENGINE CONTROL SENSOR

The present application claims priority to U.S. Provisional Patent Application Ser. No. 60/156,881, filed Sep. 30, 1999.

BACKGROUND OF THE INVENTION

The present invention relates to an engine control sensor, and more particularly to an ECU mounted directly to an engine intake manifold.

Various types of engine control units (ECU) have been used in the field of vehicle engines. Known ECUs are typically mounted remote from the vehicle engine to protect the ECU electronics from the heat of the vehicle engine. The ECU communicates with a plurality of sensors which are commonly installed in various vehicle engine components such as intake manifolds, air cleaners, and fuel rails. The ECU communicates with the remote sensors through a wiring harness or the like.

Remote mounting of the ECU and the multiple of sensor requires a plurality of wiring harnesses, sensor connectors, sensor mounts and other connections necessary for each remote sensor to communicate with the ECU. This is expensive and may reduce reliability due to the extensive connections.

Accordingly, it is desirable to integrate the ECU components to enhance reliability, reduce costs and improve performance.

SUMMARY OF THE INVENTION

The vehicle fluid directing assembly according to the present invention includes a an engine control unit (ECU) mounted directly to the intake manifold to provide engine management and diagnostic functions. The ECU includes a controller and a multiple of sensors such as accelerometers, temperature sensors, flow sensors, and the like, mounted to a circuit board. The sensors are preferably mounted to the circuit board at a chip level to communicate with the controller through connections such as substrate tracks. Substrate mounting of the sensors advantageously eliminates the requirement for wiring harnesses, sensor connectors, sensor mounts and other connections commonly necessary for remote sensors.

A case encloses the ECU to hermetically seal and protect the circuit board and attached components. In one embodiment, an aperture in the case and a corresponding aperture in the intake manifold allows a sensor to extend into the intake manifold. Accordingly, the sensor receives a direct input of such quantities as temperature, airflow rate, pressure, or other inputs which are directly conveyed to the ECU controller.

In another embodiment, a second aperture is aligned with a second corresponding aperture through a second vehicle component, such as a fuel rail. Accordingly, the sensor receives a direct input of quantities related to the flow of fuel through the fuel rail which are conveyed to the controller In another embodiment, a sensor such as an accelerometer which does not extend from the case receives vibration input. For example only, spark knock is of interest to ignition control and is measured by engine vibrations. As the entire circuit board is directly mounted to the intake manifold, the vibrations are received as input to the sensor.

In yet another embodiment, a sensor operates only during specified windows to sense fuel injector opening and closing. Such information advantageously provides diagnostic functions to satisfy regulations such as On board Diagnostic phase 2 (OBD2) requirements.

The present invention therefore provides an integrated ECU to enhance reliability, reduce costs and improve performance while reducing the necessity of remotely mounted components.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
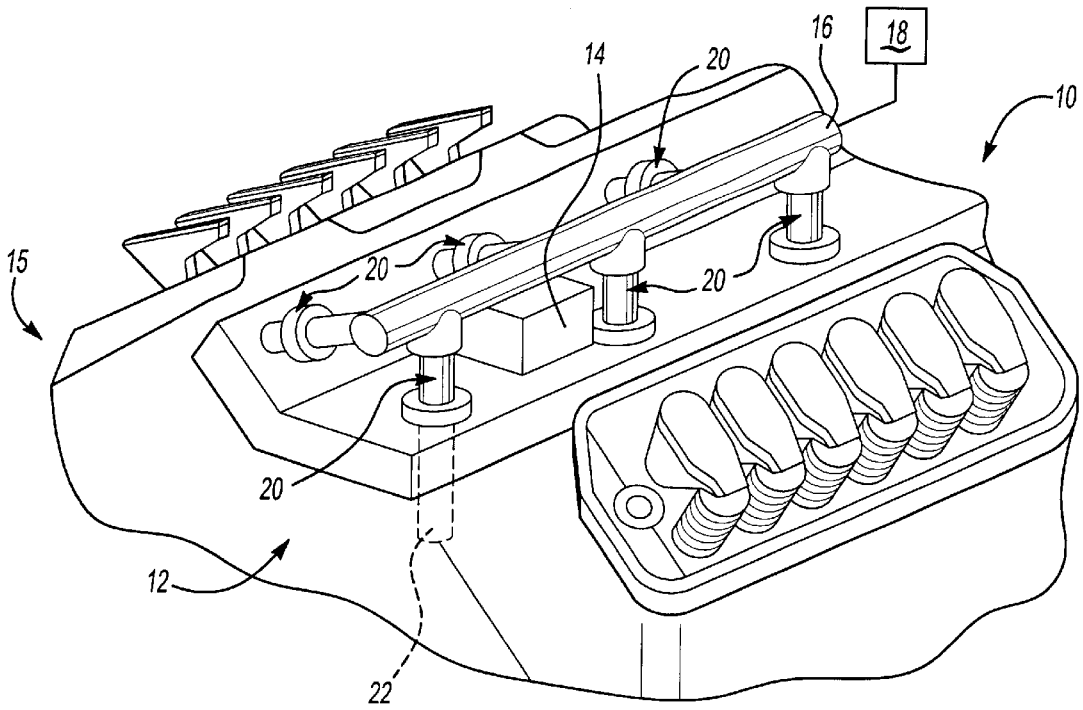
FIG. 1 is a fragmentary perspective view of an engine with an integrated fuel rail intake manifold and a fuel injector mounting according to the invention.

FIG. 1 illustrates a vehicle fluid directing assembly 10 such as an intake manifold 10 affixed to an engine (illustrated substantially schematically at 12). An engine control unit (ECU) 14 is preferably mounted directly to the intake manifold 10 to provide engine management and diagnostic functions.

The intake manifold 10 is preferably manufactured of a substantially non-metallic material such as nylon, PET, LCP, PPC, PBT or various other plastics. The use of an intake manifold is for illustrative purposes only, and the methodology of the present invention may be applied to other fluid directing vehicle components.

A cylinder head 15 is mounted to the engine 12 in conventional fashion. A fuel rail portion 16, provides a fuel supply passage 17 (FIG. 2) to supply fuel from a fuel tank (shown schematically at 18) to a plurality of fuel injectors 20 and into a respective engine cylinder 22.

Figure 2:
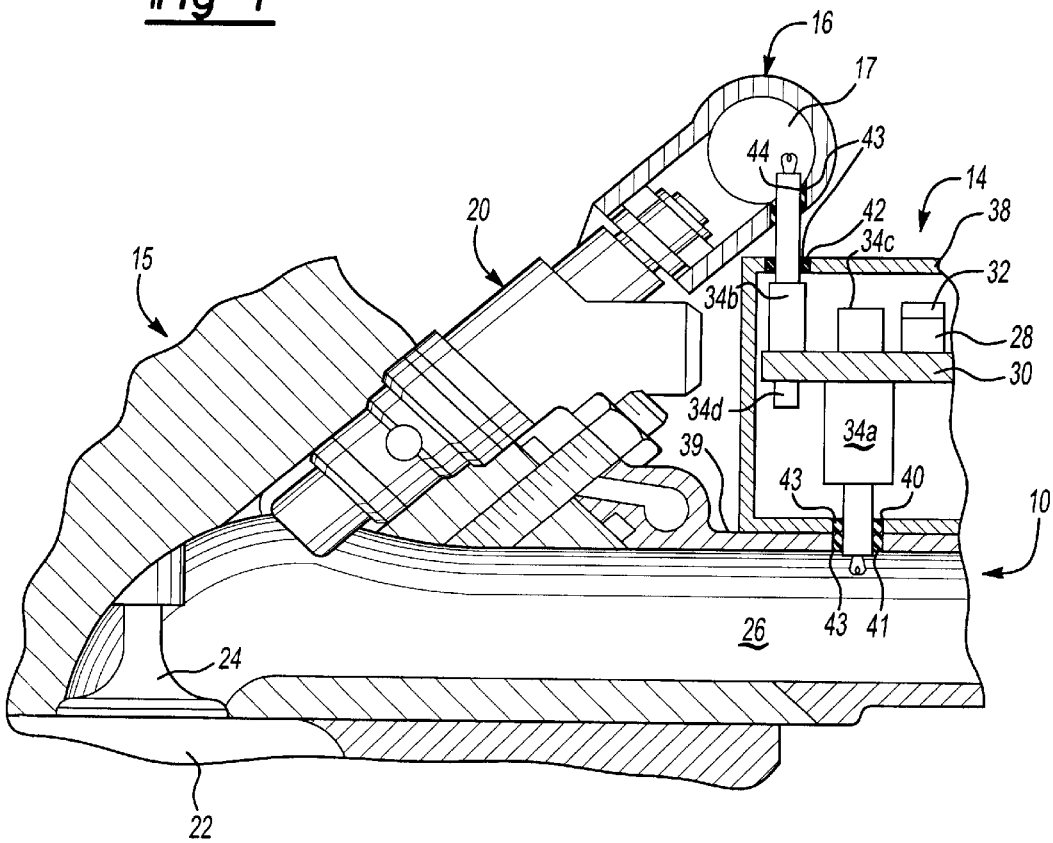
FIG. 2 is a expanded fragmentary, partially sectional view of a fuel injector mounting and integrated fuel and intake manifold of FIG. 1.

Referring to FIG. 2, the cylinder head 15 includes a runner passage 26 for each engine cylinder extending to an intake valve or valves 24 at each cylinder. Each cylinder is aligned with a runner passage 26 of the intake manifold 10. Each fuel injector 20 is operated by the ECU 14 to direct a controlled flow of fuel into the respective engine cylinder 22 at timed intervals.

The ECU 14 includes a controller 28 which is typically mounted on a circuit board or substrate 30 to implement the engine management and diagnostic function preferably through software stored in a memory 32. Preferably, a multiple of sensors 34, such as accelerometers, temperature sensors, flow sensors, and the like, are mounted to the circuit board 30. Most preferably, the sensors 34 are mounted to the circuit board 30 at a chip level to communicate with the controller 28 through connections 36 such as substrate tracks on the circuit board 30. Substrate mounting of the sensors 34 advantageously eliminates the requirement for wiring harnesses, sensor connectors, sensor mounts and other connections commonly necessary for a remote sensor to communicate with the circuit board 30.

A case 38 encloses the ECU 14 to hermetically seal and protect the circuit board 30. The case 38 is preferably a heat conducting material such as aluminum and is mounted directly to an outer surface 39 of the intake manifold 10. The case 38 is located in a strategic location on the intake manifold 10 such that the sensors 34 receive inputs therefrom.

An aperture 40 in the case 38 and a corresponding aperture 41 in the intake manifold 10 allows a sensor 34A to extend into the intake manifold 10. Preferably, a seal 43, such as an O-ring or the like assures that the case 38 is sealed proximate the sensor 34A to protect the ECU 14 from the sensed medium passing through the runner passage 26 of the intake manifold 10. Accordingly, the sensor 34A receives a direct input of such quantities as temperature, airflow rate, pressure, or other inputs which are directly conveyed to the controller 28.

Figure 2A:
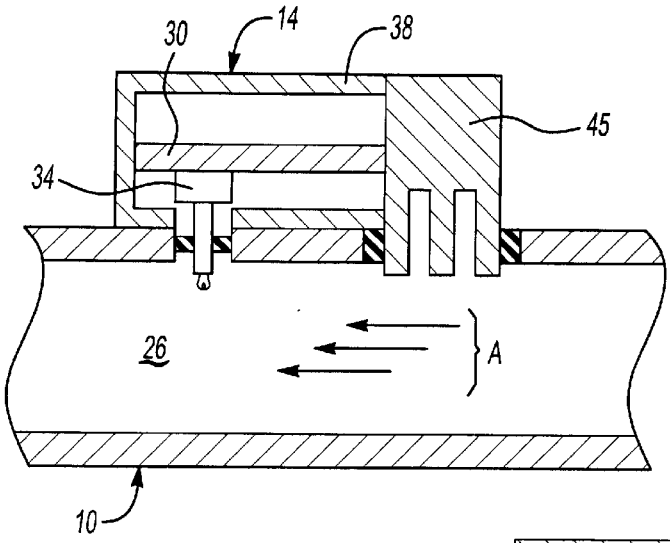
FIG. 2A is a fragmentary, partially sectional view of the ECU of FIG. 2.

As the ECU 14 is mounted in rather close proximity to heat generating vehicle components, a cooling device 45 such as a heat sink is provided. The cooling device 45 (FIG. 2A) is preferably a portion of the case 38, however the cooling device 45 may also be an independent component attached directly to the circuit board 30. It should be understood that the cooling device 45 may also be an active component such as a fan which is attached and draws power directly from the circuit board 30. The case 38 is preferably mounted to locate the heat sink 45 in communication with a circulating fluid (illustrated schematically as arrows A) such as, the air passing through the intake manifold 10 or the fuel to the fuel injectors, or to assist in maintaining the ECU 14 at an acceptable temperature.

Figure 2B:
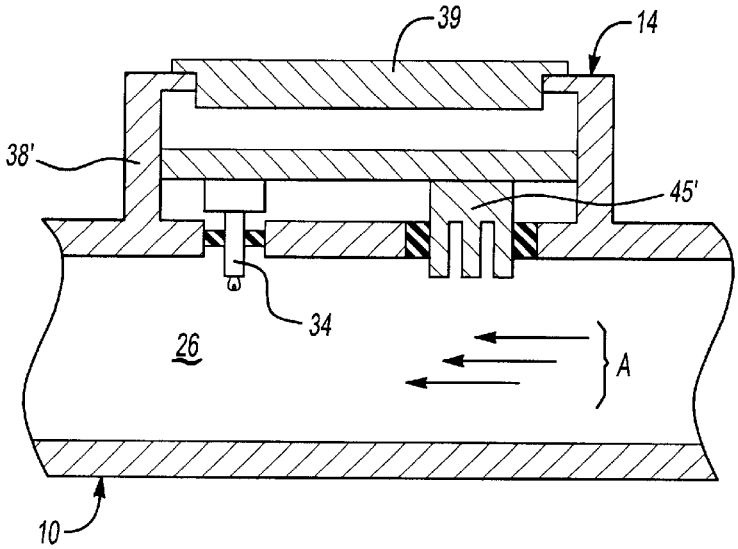
FIG. 2B is another fragmentary, partially sectional view of the ECU of FIG. 2.

In another embodiment, the case 38' (FIG. 2B), is integrally formed within the intake manifold 10. Only a cover 39 need be removably attached to the case 38' to seal the circuit board 30 within the ECU 14 and provide access thereto. In the embodiment illustrated in FIG. 2B, the heat sink 45 is mounted directly to the circuit board 30 such that it extends into communication with a circulating fluid (illustrated schematically as arrows A) such as, the air passing through the intake manifold 10 or the fuel to the fuel injectors, or to assist in maintaining the ECU 14 at an acceptable temperature.

In another embodiment, a second aperture 42 is aligned with a second corresponding aperture 44 through a second vehicle component, such as fuel rail 16. Accordingly, sensor 34B receives a direct input of quantities related to the flow of fuel through the fuel rail 16 which are conveyed to the controller 28. A seal 43, such as an O-ring or the like assures that the case 38 and fuel rail 16 are sealed.

It should be understood that the second corresponding aperture 44 can also be located through the intake manifold at a second location. By strategically locating the ECU 28, a multiple of sensors 34 will have access to various inputs, from a multiple of vehicle components. For example only, the sensors 34 can be exposed to such inputs as fuel pressure by accessing the fuel rail; the inlet air temperature by accessing the air cleaner or manifold; the manifold pressure by accessing the manifold; the fuel composition by accessing the fuel rail; the airflow direction by accessing the manifold or air cleaner; the mass airflow by the manifold or air cleaner; or barometric pressure by accessing the air cleaner.

In another embodiment, a sensor 34C such as an accelerometer can receive vibration input. Notably, sensor 34C need not extend from the case 38. For example only, spark knock is of interest to ignition control and is measured by engine vibrations. As the entire circuit board 3 is directly mounted to the intake manifold 10, the vibrations are received as input to the sensor 34C.

In another embodiment, a sensor 34D is also an accelerometer. Sensor 34D preferably operates only during specified windows to sense fuel injector opening and closing. Such information advantageously provides diagnostic functions to satisfy regulations such as On board Diagnostic phase 2 (OBD2) requirements.

Figure 3:
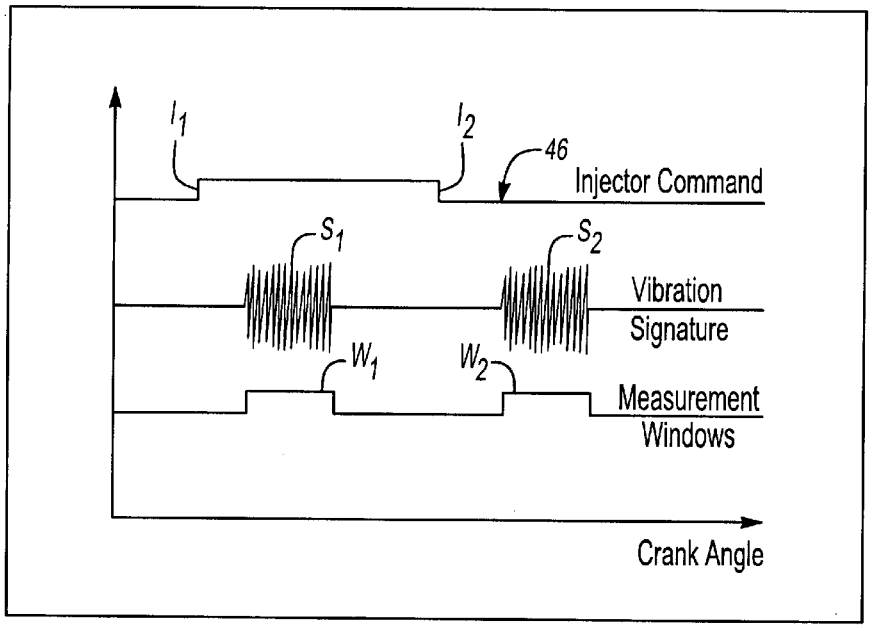
FIG. 3 is a schematic diagram illustrating operation of one embodiment of the present invention.

Referring to FIG. 3, an injection command is initiated at point I1 and terminated at point I2 as illustrated by injector command signal 46. Algorithms for the operation of injectors are known and are typically controlled by the ECU 28. The opening and closing of an injector in response to the injector command signal 46, will results in a vibration signature at points S1 and S2. Preferably, the sensor 34D is only operative during measurement windows W1, and W2 which should optionally correspond with the ECU 14 vibration signature points S1 and S2.

Fuel injectors are commonly mounted proximately to the intake manifold and the vibration signature of a fuel injector is transmitted to the sensor 34D. The ECU 14 controls the injector command signal 46 and can calculate the timing of the optimal expected opening S1 and closing S2 of the injector. The ECU 14 determines the corresponding timing of the measurement windows W1 and W2. Measurement windows W1 and W2 are preferably provided by selective communication between the controller 28 and the sensor 34D.

As long as the vibration signature points S1 and S2 occur during the measurement windows W1 and W2, the ECU 14 verifies that the fuel injectors are operating within proper limits. However, should no vibration signal be identified during the measurement windows W1 and W2, the ECU 14 will determine that a problem exists. For example, no vibration signal will be present for a stuck injector. Further, as the measurement windows W1 and W2 are preferably located at the optimal timing location for each fuel injector sequencing, a vibration signature indicative of early or late operation will not correspond with the measurement windows W1 and W2 which is also indicative of a problem. In response to such a problem, the ECU 14 will then provide an alert such as an OBD2 warning light or the like such that corrective action for the particular malfunctioning injector can be provided.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. An intake manifold assembly comprising:

a substantially non-metallic runner passage for directing a gas, said runner passage comprising an intake manifold outer surface;

an engine control unit having a controller in communication with a sensor; and a case hermetically sealing said engine control unit, said case mounted to said outer surface and adjacent said runner passage and a second vehicle component, said sensor extending at least partially through said case and at least partially into said runner passage to receive a first input.

2. The assembly as recited in claim 1, further comprising a fuel injector at least partially mounted within said runner passage.

3. The assembly as recited in claim 1, further comprising a cooling device adjacent said case.

4. The assembly as recited in claim 3, wherein said sensor only communicates with said controller during intervals in response to said engine control unit.

5. The assembly as recited in claim 1, wherein said sensor includes an accelerometer.

6. The assembly as recited in claim 1, wherein said engine control unit includes a substrate, said controller and said sensor mounted to said substrate.

7. The assembly as recited in claim 6, further comprising a heat sink extending from said substrate, said heat sink extending at least partially through said case and at least partially into said runner passage.

8. The assembly as recited in claim 1, further comprising a second sensor in communication with said controller, said second sensor operable to receive a second input related to a second vehicle component.

9. The assembly as recited in claim 1, wherein said second vehicle component comprising a fuel rail.

10. A method of identifying a malfunctioning fuel injector with an engine control unit having a controller and a sensor, said engine control unit mounted to a substantially non-metallic intake manifold, said method comprising the steps of:

(1) sending an injector operating command;

(2) determining an optimal expected opening and closing time period for the injector based upon said injector operating command of said step (1);

(3) determining a first measurement window corresponding with said optimal expected opening time period for the injector and a second measurement window corresponding with said optimal expected closing time period for the injector;

(4) identifying whether a vibration signal exists during each of said first and said second measurement windows.

11. A method as recited in claim 10, wherein said step (3) further comprises communicating with the sensor only during said first and second measurement window.

* * * * *